US007946549B2

(12) United States Patent
Forrest et al.

(10) Patent No.: US 7,946,549 B2
(45) Date of Patent: May 24, 2011

(54) HANGER HOOK ASSEMBLY FOR WIRE SHELF

(75) Inventors: Earl David Forrest, Asheboro, NC (US); James Leroy Daniels, Stokesdale, NC (US); James Allen Austin, III, High Point, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 0 days.

(21) Appl. No.: 11/958,672

(22) Filed: Dec. 18, 2007

(65) Prior Publication Data

US 2009/0152424 A1 Jun. 18, 2009

(51) Int. Cl.

| | |
|---|---|
| ***A47G 29/02*** | (2006.01) |
| ***E04G 3/08*** | (2006.01) |
| ***E06B 7/28*** | (2006.01) |

(52) U.S. Cl. ..... 248/249; 248/235; 248/250

(58) Field of Classification Search ..... 211/123, 211/153, 90.03, 105.01; 248/214, 215, 317, 248/339, 340, 303, 304

See application file for complete search history.

(56) References Cited

U.S. PATENT DOCUMENTS

| | | | | |
|---|---|---|---|---|
| 5,350,072 | A | 9/1994 | Rogers et al. | |
| 5,405,026 | A * | 4/1995 | Lee et al. | 211/123 |
| 5,531,416 | A * | 7/1996 | Remmers | 248/222.51 |
| 5,758,851 | A * | 6/1998 | Remmers | 248/251 |
| 5,836,461 | A | 11/1998 | Kokenge et al. | |
| D437,515 | S | 2/2001 | Remmers et al. | |
| 7,004,335 | B2 | 2/2006 | Remmers | |
| 7,086,544 | B1 | 8/2006 | Doench | |
| 7,185,772 | B2 | 3/2007 | Remmers | |
| 2005/0077261 | A1 | 4/2005 | Remmers | |
| 2005/0150436 | A1 * | 7/2005 | Marchetta et al. | 108/108 |

OTHER PUBLICATIONS

Closetmaid, How to plan and install the closet project of your dreams, Project Planner & Installation Guide, Emerson Storage Solutions.

* cited by examiner

*Primary Examiner* — Amy J Sterling
(74) *Attorney, Agent, or Firm* — Carlson Gaskey & Olds PC

(57) ABSTRACT

An example hanger hook assembly for a wire shelf includes a rod end portion and a hanging rod extending from the rod end portion. A hanger end portion mounts to a wire shelf, and the hanger end portion aligns with a wire shelf storage surface. A hook portion extends from the hanger end portion to the rod end portion. The hook portion is concave between the hanger end portion and the hook end portion.

23 Claims, 2 Drawing Sheets

HANGER HOOK ASSEMBLY FOR WIRE SHELF

BACKGROUND OF THE INVENTION

This invention relates generally to a hanger hook assembly for securing a hanger rod adjacent a wire shelf.

Wire storage shelves are known. Storage areas such as closets and laundry rooms use wire shelves to store clothes and linens, for example. Wire shelves typically include parallel shelf wires arranged to provide a storage surface. The parallel shelf wires may bend down near the front edge of the wire shelf. Thicker supporting wires attach to the undersides of the parallel shelf wires, perpendicular to the other shelf wires.

The storage surface is suitable for storing folded clothes, but a user may desire to hang some types of clothes. Wire or plastic hangers are typically used to hang clothes, such as dress shirts. The hangers commonly include a looped end for hanging over a rod. Sliding the looped end along the rod moves the hanger and the hanging clothes, facilitating access to the hanging clothes.

Hanging the looped end directly from one of the shelf wires or supporting wires is often undesirable because the looped end contacts the other wires in the wire shelf when moving the looped end. This limits access to the hanging clothes. Some storage areas may include permanent hanging rods mounted apart from the wire shelf, but these permanent hanging rods limit potential storage configurations and increase overall costs.

SUMMARY OF THE INVENTION

An example hanger hook assembly for a wire shelf includes a rod end portion and a hanging rod extending from the rod end portion. A hanger end portion mounts to a wire shelf, and the hanger end portion aligns with a wire shelf storage surface. A hook portion has a length extending from the hanger end portion to the rod end portion, the hook portion is concave along the length relative to a point located between the hanger end portion and the hook end portion.

Another example hanger hook assembly for a wire shelf includes a bracket for spanning a plurality of shelf wires, a hanging rod aligned with the plurality of shelf wires, and a hook mounted to the bracket. The hook has a length extending from adjacent the bracket to the hanging rod. The length maintains concavity relative to a point located between the bracket and a portion of the hook.

Another example hanger rod assembly for a shelf includes a plurality of brackets each for spanning adjacent shelf wires. A plurality of hooks each have a hanger end portion for hanging from one of the plurality of brackets and a loop portion extending from the hanger portion. A hanging rod secures to the loop portion of each of the plurality of hooks.

BRIEF DESCRIPTION OF THE DRAWINGS

These and other features of the present invention can be best understood from the following specification and drawings, the following of which is a brief description.

DETAILED DESCRIPTION OF AN EXAMPLE EMBODIMENT

Figure 1:
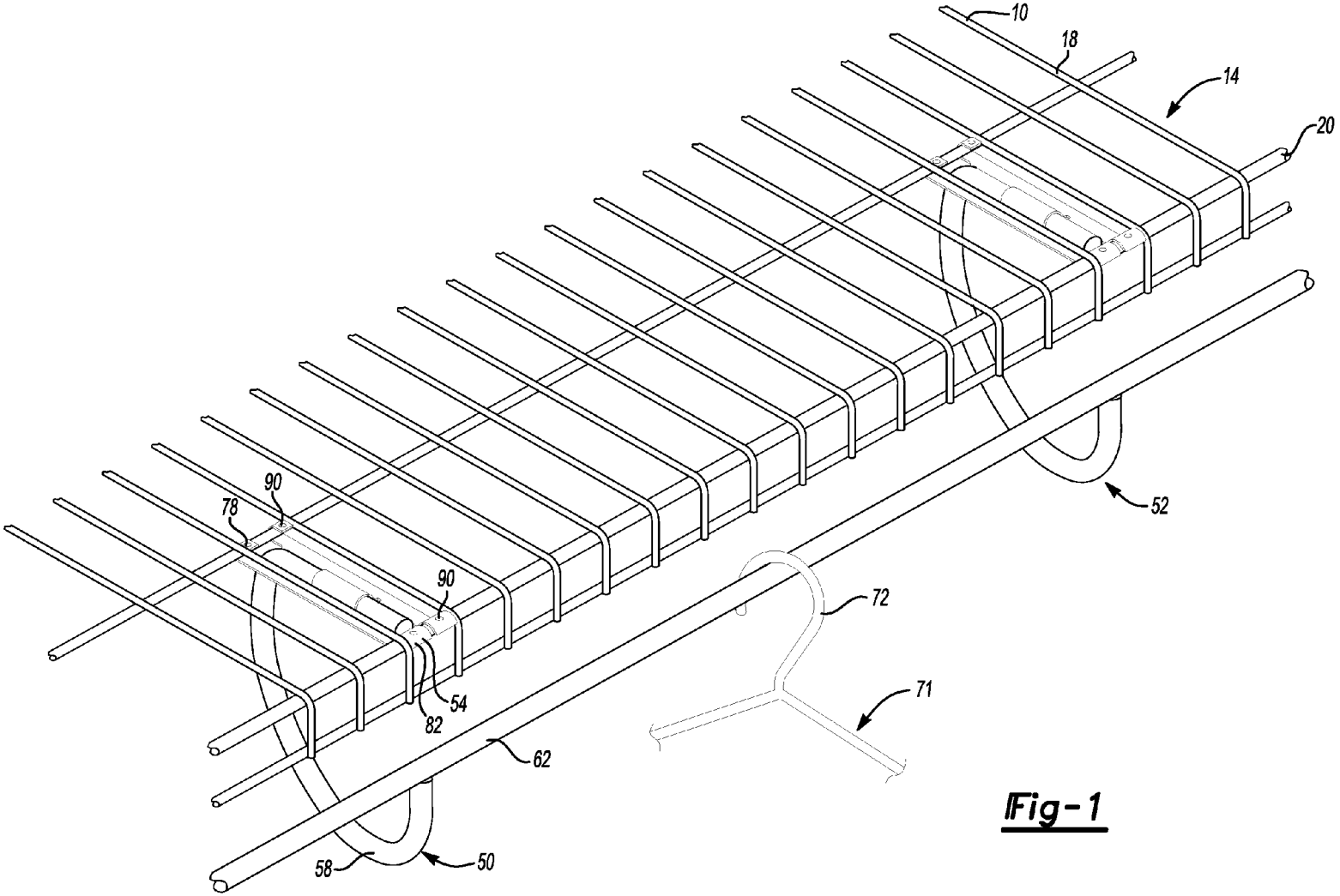
FIG. 1 illustrates a perspective view of an example hanger hook assembly secured to a wire shelf.

A standard wire shelf 10 includes a plurality of shelf wires 18 arranged to form a wire shelf storage surface 14, as shown in FIG. 1. The shelf storage surface 14 provides a storage location for folded clothes, for example. Brackets (not shown) secure the wire shelf 10 to a wall in a known manner. Some of the shelf wires 18 are support wires 20, which are transverse to the shelf wires 18 that provide the shelf storage surface 14. In this example, the support wires 20 are arranged under the shelf wires 18 that provide the shelf storage surface 14.

An example hanger hook assembly 50 includes a bracket 54 and a hook 58. The bracket 54 engages support wires 20 to hang the hanger hook assembly 50 from the wire shelf 10. As the bracket 54 engages support wires 20 between other adjacent shelf wires 18, some of the shelf wires 18 limit sliding movements of the bracket 54 parallel to the support wires 20. A hanging rod 62 is attached to the hook 58. In the example, the hanging rod 62 is welded to the hook 58. The hanging rod 62 is supported by, and may extend between the hanger hook assembly 50 and the hook of an adjacent hanger hook assembly 52. A clothes hanger 71 includes a looped end portion 72 for hanging the hanger 71 from the hanging rod 62. The geometry of the remaining portions of the hanger hook assembly 50 provides clearance for looped end portion 72 of the clothes hanger to slide along the hanging rod 62.

Figure 2:
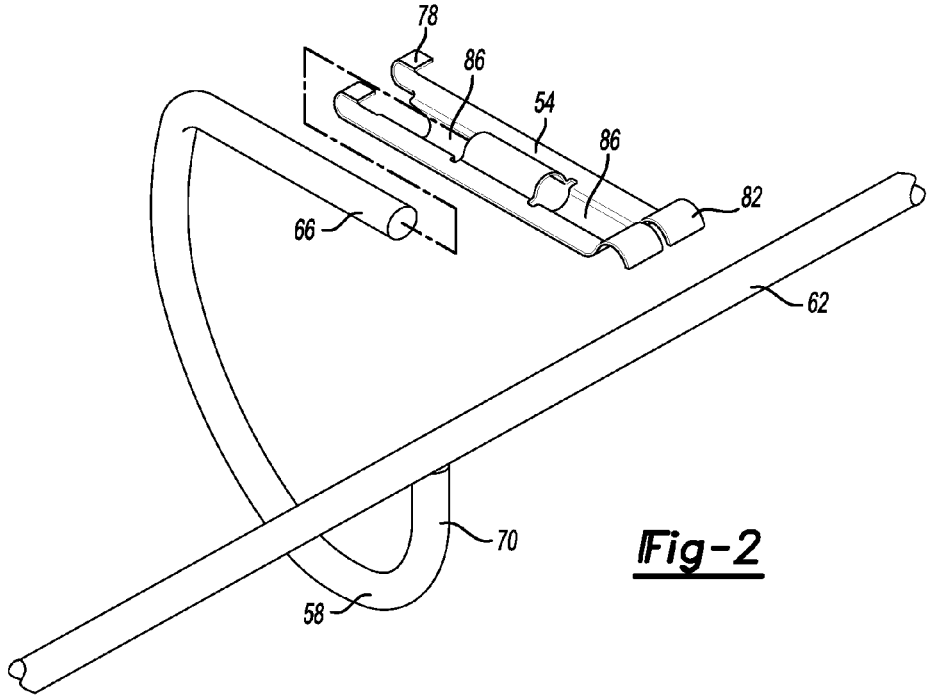
FIG. 2 illustrates an exploded view of the hanger hook assembly of FIG. 1.
Figure 3:
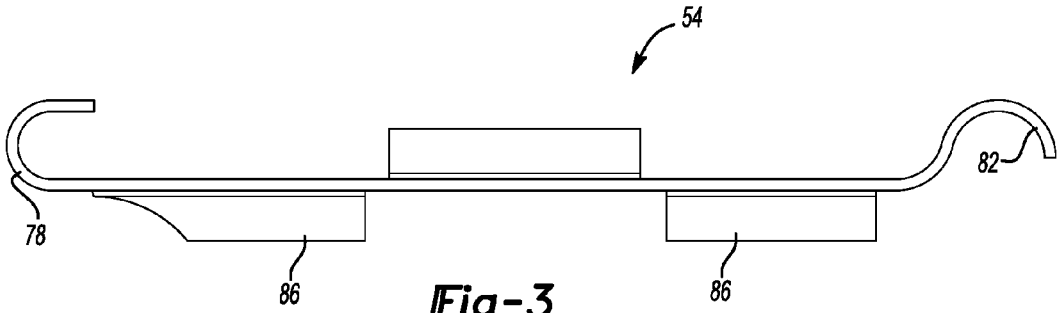
FIG. 3 illustrates a side view of the bracket of FIG. 1.

Referring now to FIGS. 2 and 3, the hook 58 has a hanger end portion 66 and a rod end portion 70. The bracket 54 receives the hanger end portion 66 of the hook 58, and the hanging rod 62 extends from the rod end portion 70. The bracket 54 includes two hooked bracket end portions 78, 82 for engaging and spanning support wires 20 of the wire shelf 10, which are supporting wires in this example. In this example, one end of the bracket 54 includes at least one upturned hook 78 and the other end of the bracket 54 includes at least one downturned hook 82. Both hooks 78, 82 engage shelf wires 20 below the wire shelf support surface 14 (FIG. 1) to lessen interference when moving items to a storage location on the support surface 14.

The example bracket 54 also includes a plurality of bracket hangers 86 extending away from other portions of the bracket 54. The bracket hangers 86 are sized to receive the hanger end portion 66 of the hook 58 and hold the hanger end portion 66 substantially parallel to the wire shelf storage surface 14. Some of the bracket hangers 86 engage a lower surface of the hanger end portion 66 while another bracket hanger loops over an upper surface of the hanger end portion 66.

The bracket hangers 86 limit some movements of the hanger end portion 66, but in this example permit disengaging the hanger end portion 66 from the bracket hangers 86 when moving the hanger end portion 66 away from the downturned hook 82 aligned with the wire shelf support surface 14 (FIG. 1). The weight of the hook 58, the hanging rod 62, and items hanging from the hanging rod 62 pulls the hanger end portion 66 toward the interior surface of the bracket hangers 86, which helps limit other movements of the hanger end portion 66 relative the bracket hangers 86. Other examples may crimp the bracket hangers 86 against the hanger end portion 66 to discourage movement of the hanger end portion 66 relative to the bracket hangers 86.

Figure 4:
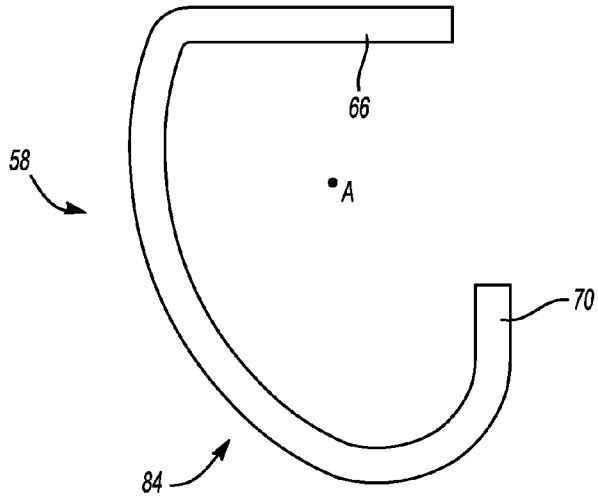
FIG. 4 illustrates a side view of the hook portion of FIG. 1.

Referring now to FIG. 4, the example hook 58 includes a loop portion 84 having a length extending from the hanger end portion 66 to the hanging rod 62. The loop portion 84 is concave along the length relative to a point located between the loop portion 84 and the hanger end portion 66, such as point A, for example. The concavity relative to point A provides clearance for the looped end portion 72 of the clothes hanger.

Referring again to FIG. 1, a user wishing to install the hanger hook assembly 50 to a standard wire shelf 10 may engage one of the support wires 20 with the upturned hook 78 and rest the downturned hook 82 against another of the support wires 20. Such an installation facilitates removal of the hanger hook assembly 50 from the wire shelf 10 if the hanger rod 62 is no longer desired. To remove the hanger hook assembly 50 from the support wires 20, the user first lifts end of the bracket 54 with the downturned hook 82 away from one of the support wires 20. The user then slides the upturned hook 78 off of another of the support wires 20 and moves the hanger hook assembly 50 downward and away from the shelf wires 18.

In this example however, the bracket 54 includes a plurality of designated weld areas 90 for securing the bracket 54 to the upper portion of the support wires 20. The example weld area 90 includes opening that exposes a portion of the underlying support wires 20. The exposed underlying support wires 20 can then be welded to the bracket 54. The weld areas 90 provide suitable area to weld the bracket 54 to the support wires 20 if desired. Welding the bracket 54 to the support wires 20 limits relative movement between the hanger hook assembly 50 and the wire shelf 10.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A hanger hook assembly for a wire shelf comprising:

a rod end portion;

a hanging rod extending from said rod end portion;

a hanger end portion mountable relative to a wire shelf, said hanger end portion positioned below a storage surface of the wire shelf when said hanger end portion is in a mounted position;

a hook portion having a length extending from said hanger end portion to said rod end portion, said hook portion concave along said length relative to a point located between said hanger end portion and said rod end portion; and a bracket mountable directly to the wire shelf, said bracket, configured to be supported by at least one wire of the wire shelf, said bracket having at least one hooked bracket end portion, having a concave surface configured to receive the at least one wire of the wire shelf, said hanger end portion configured to slidably engage with said bracket.

2. The hanger hook assembly of claim 1, wherein said rod end portion is substantially perpendicular to said storage surface.

3. The hanger hook assembly of claim 1, wherein said bracket comprises an upturned bracket hook configured to receive a wire of the wire shelf, a downturned bracket hook configured to receive another wire of the wire shelf, and a bracket hanger configured to receive said rod end portion.

4. The hanger hook assembly of claim 1, wherein said bracket includes weld areas for welding said bracket.

5. A hanger hook assembly for a wire shelf comprising:

a bracket configured to span a plurality of shelf support wires;

a hanging rod aligned with said plurality of shelf support wires, said bracket having at least one hooked bracket end portion having a concave surface configured to receive at least one of the shelf support wires, said bracket configured to be supported by the at least one of the shelf support wires; and a hook removeably engagable with at least a portion of said bracket, said hook having a length extending from adjacent said bracket to said hanging rod, wherein said length maintains concavity along said length from said bracket to said hanging rod.

6. The hanger hook assembly of claim 5, wherein said bracket includes a plurality of hooked bracket end portions each configured to engage at least one of the plurality of shelf support wires, wherein said bracket is positioned below a storage surface of a wire shelf supported by the shelf support wires when the plurality of hooked bracket end portions engage the plurality of shelf support wires.

7. The hanger hook assembly of claim 6, wherein said plurality of hooked bracket end portions includes an upturned bracket hook and a downturned bracket hook.

8. The hanger hook assembly of claim 7, wherein said upturned bracket hook receives one of said plurality of shelf support wires rearward of one of said plurality of shelf support wires received by said downturned bracket hook.

9. The hanger hook assembly of claim 5, wherein said hook includes a hanger portion aligned with said bracket, said hanger portion configured to engage with said bracket.

10. The hanger hook assembly of claim 9, wherein said hanger portion is substantially straight.

11. The hanger hook assembly of claim 5, wherein said bracket includes at least one weld area for welding said bracket to said plurality of shelf support wires.

12. The hanger hook assembly of claim 5, wherein at least one of said hook or said hanging rod comprises wire.

13. The hanger hook assembly of claim 1, wherein said hanger hook comprises wire.

14. The hanger hook assembly of claim 5, wherein said hook is received within a bracket hanger portion of said bracket.

15. A hanger rod assembly for a wire shelf comprising:

a plurality of brackets each configured to be suspended from wires of a wire shelf; said brackets each having at least one hooked bracket end portion having a concave surface configured to receive at least one of the wires of the wire shelf;

a plurality of hooks each having a hanger end portion configured to hang from a corresponding one of said plurality of brackets and a loop portion extending from said hanger portion, the hanger end portion removeably engageable with said corresponding one of said plurality of brackets; and a hanging rod adhered to said plurality of hooks.

16. The hanger rod assembly of claim 15, wherein the wires are shelf support wires, and the wire shelf includes other wires that are transverse to the shelf support wires and that limit sliding movements of the plurality of brackets.

17. The hanger rod assembly of claim 15, wherein said plurality of brackets each include an upturned hook configured to receive one of said wires and a downturned hook configured to receive the other one of said adjacent wires.

18. The hanger rod assembly of claim 15, wherein each of said plurality of brackets includes at least one weld area for welding said bracket to one of said wires.

19. The hanger rod assembly of claim 15, wherein each of said plurality of hooks is a wire hook.

20. The hanger hook assembly of claim 1, wherein said bracket is exclusively supported by said wire shelf.

21. The hanger hook assembly of claim 5, wherein said bracket is further configured to be supported exclusively by said plurality of shelf support wires.

22. The hanger hook assembly of claim 5, wherein said bracket extends between some of said plurality of shelf support wires.

23. The hanger rod assembly of claim 15, wherein said plurality of brackets are configured to be supported entirely by said wires of said wire shelf.

* * * * *